United States Patent [19]

Kloster

[11] 4,434,978

[45] Mar. 6, 1984

[54] VISE

[76] Inventor: Kenneth D. Kloster, 6649 Millridge, Maumee, Ohio 43537

[21] Appl. No.: 504,083

[22] Filed: Jun. 16, 1983

Related U.S. Application Data

[63] Continuation of Ser. No. 242,379, Mar. 10, 1981, abandoned.

[51] Int. Cl.[3] ..... B25B 1/04

[52] U.S. Cl. ..... 269/69; 269/101; 269/238; 269/246; 269/902

[58] Field of Search ..... 269/238, 246, 902, 213, 269/207, 69, 76, 101, 237; 24/248 SA, 299 R; 248/226.2, 316 B; 81/186, 53 A, 111

[56] References Cited

U.S. PATENT DOCUMENTS

| | | | |
|---|---|---|---|
| 652,674 | 6/1900 | Harram | 269/280 |
| 1,326,804 | 12/1919 | Taylor | 269/272 |
| 1,490,063 | 4/1924 | Tower | 269/238 |
| 1,890,114 | 12/1932 | Fulton | 269/272 |
| 2,127,008 | 8/1938 | Petersen | 269/268 |
| 2,495,308 | 1/1950 | Amigone | 81/186 |
| 2,722,147 | 11/1955 | Desfosses | 269/101 |
| 3,514,091 | 5/1970 | Johnson et al. | 269/238 |
| 3,537,150 | 11/1970 | Emerson | 24/299 R |
| 3,736,629 | 6/1973 | Blake | 24/248 SA |
| 4,258,907 | 3/1981 | Roberts et al. | 269/69 |

FOREIGN PATENT DOCUMENTS

| | | | |
|---|---|---|---|
| 516245 | 1/1931 | Fed. Rep. of Germany | 269/268 |

*Primary Examiner*—Robert C. Watson

*Attorney, Agent, or Firm*—Wilson, Fraser, Barker & Clemens

[57] ABSTRACT

The present invention relates to a vise for securely supporting a workpiece relative to a fixed support. The vise includes a base member which is secured relative to the fixed support. A clamp assembly is rotatably mounted with respect to the base member and includes a pair of jaw members one member of which, except for the relative rotative movement between the clamp assembly and the base member, is fixed relative to the base member. The second jaw member is pivotally interconnected to the first jaw member. Both jaw members have a workpiece engaging surface formed thereon with the engaging surfaces arranged in a facing relation to one another. The vise further includes a threaded handle pivotally mounted on the second jaw member and cooperating with the fixed jaw member for pivoting the jaws relative to one another to move the workpiece engaging surfaces toward one another whereby a workpiece positioned between the surfaces will be securely supported. A vise of this construction is specially suitable for supporting automotive components such as a MacPherson strut suspension assembly or a rack and pinion steering assembly, for example.

7 Claims, 5 Drawing Figures

VISE

This is a continuation of application Ser. No. 242,379 filed 3/10/81 now abandoned.

BACKGROUND OF THE INVENTION

One type of vehicle suspension system which is becoming increasingly popular is the MacPherson strut suspension system. The MacPherson strut is an integral coil spring-shock absorber assembly which provides a lightweight, compact vehicle suspension system. The MacPherson strut suspension system is disclosed in more detail in U.S. Pat. No. 2,624,592 to E. S. MacPherson.

One of the problems associated with the MacPherson strut assembly is that the shock absorber unit typically wears out before the associated coil spring. In repairing the shock absorber unit, it is often necessary to remove the entire strut assembly from the vehicle. Once removed, it is desirous for the mechanic to support the assembly in some manner during the repair procedure.

Two companies, Branick Manufacturing of Fargo, North Dakota and Walker Manufacturing of Jonesboro, Arkansas have vises which have been specifically designed to support a MacPherson strut suspension assembly. Both of these vises include a support which is bolted to a work table and clamp assembly secured to the support. The clamp assembly includes a fixed member secured to the support and a pivoted member pivotally connected to the fixed member. The MacPherson strut assembly is placed between these two members and a latch pivotally connected to the fixed member is moved into engagement with the pivoted member to pivot the clamping members toward one another to secure the strut assembly.

One of the problems with the above-described type of MacPherson strut vise is that the pivoted clamping member and the latch are both independently pivoted to the fixed clamping member. This type of construction typically requires the mechanic to utilize two hands to operate the vise. Consequently, it is difficult for a mechanic to hold the strut assembly with one hand while operating the vise with the other. Another problem associated with the above-described vise is that, since one clamping member is fixed relative to the support, the strut assembly can only be supported in a single position.

SUMMARY OF THE INVENTION

The present invention relates to an apparatus for securely supporting a workpiece relative to a fixed support. Although the apparatus is specially suitable for supporting a MacPherson strut suspension assembly, it is also suitable for supporting other workpieces such as a rack tube of a rack and pinion steering assembly, for example. The apparatus includes a base member which is secured relative to a fixed support. A clamp means is rotatably mounted with respect to the base member. Means are provided for releasably securing the rotatable clamp means relative to the base member at predetermined intervals to militate against any relative rotative movement therebetween. The clamp means includes a pair of jaw members one member of which, except for the relative rotative movement between the clamp means and the base member, is fixed relative to the base member. The second jaw member is pivotally interconnected to the first jaw member. Both jaw members have a workpiece engaging surface formed thereon with the engaging surfaces arranged in a facing relation to one another.

The apparatus further includes means mounted on the second jaw member and cooperating with the fixed jaw member for pivoting the jaws relative to one another to move the workpiece engaging surfaces toward one another whereby a workpiece positioned between the surfaces will be securely supported.

Such a vise construction provides several advantages over the above-discussed prior art. First, because the clamp means of the vise is rotatably mounted with respect to the fixed base member, the vise can be used in a variety of applications which require a workpiece to be supported in different positions. Secondly, since the means for pivoting the jaw members is located on the pivoted jaw, the operation of the vise is simplified by permitting a mechanic to operate the vise with one hand while positioning the workpiece with the other.

BRIEF DESCRIPTION OF THE DRAWINGS

The above, as well as other objects and advantages of the invention, will become readily apparent to one skilled in the art when reading the following detailed description of the invention when considered in light of the accompanying drawings, in which.

DESCRIPTION OF THE PREFERRED EMBODIMENT

Figure 1:
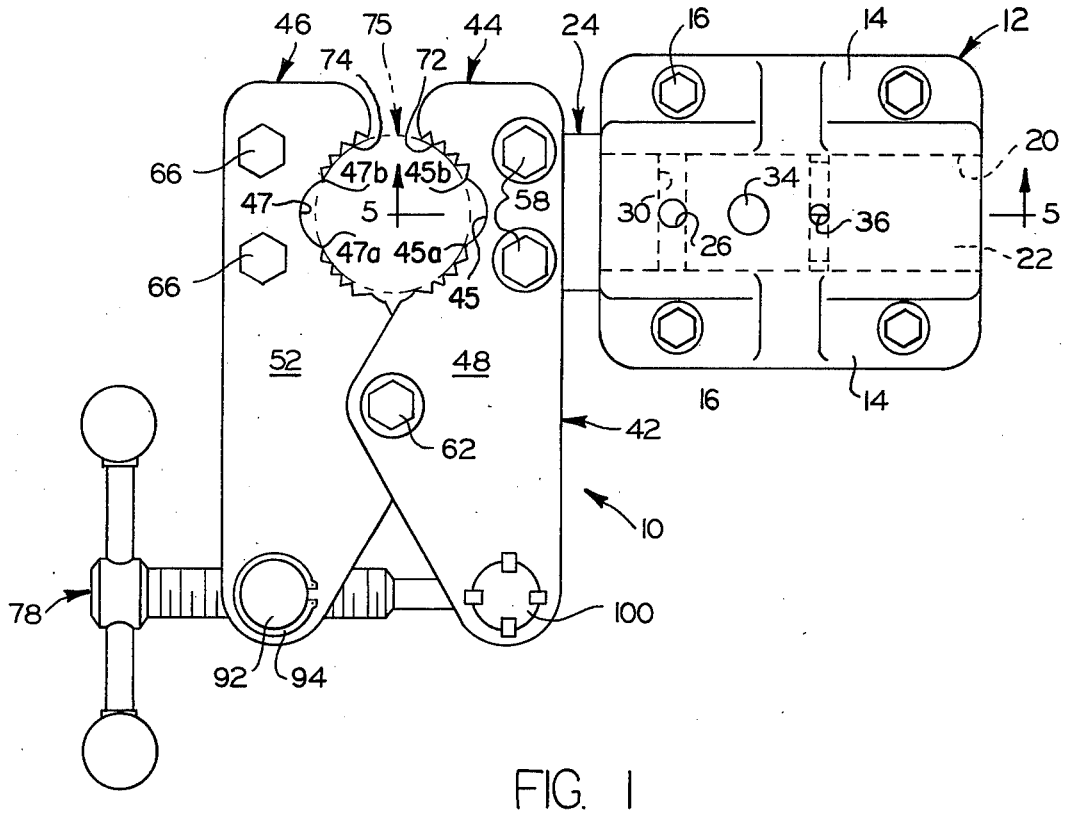
FIG. 1 is a top plan view of a vise embodying the features of the present invention.
Figure 2:
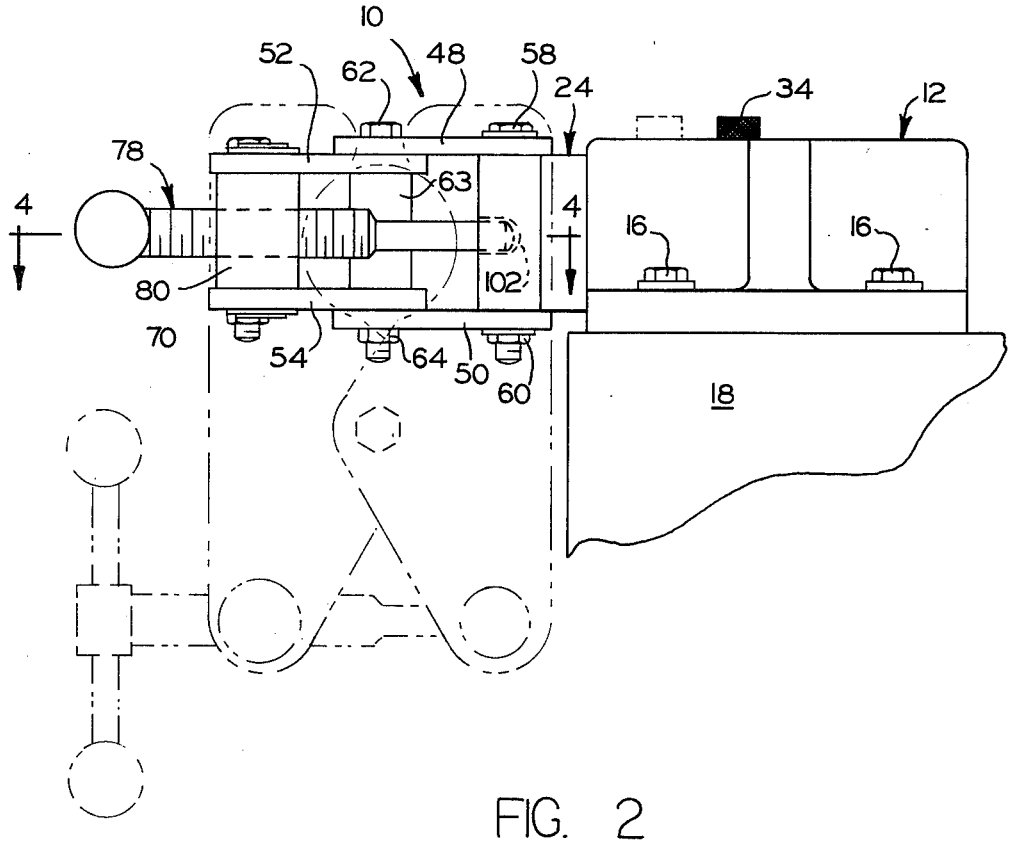
FIG. 2 is a side elevational view of the vise shown in FIG. 1 illustrating in phantom the position of the clamp means after it has been rotated 90° with respect to the fixed support.
Figure 3:
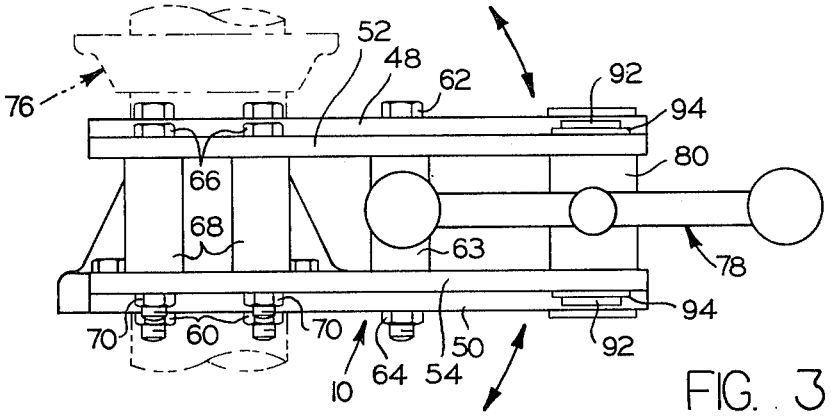
FIG. 3 is a front elevational view of the vise shown in FIG. 1.

Referring to FIGS. 1, 2, and 3, there is shown a vise generally indicated by reference numeral 10 embodying the features of the present invention. The vise 10 includes a base member 12 having flage portions 14 adapted to receive a plurality of bolts 16 for securely mounting the base member to a fixed support 18. The base member 12 has a longitudinally and centrally disposed cylindrical aperture 20 formed therein for receiving a cylindrical end portion 22 of a support member 24.

Figure 5:
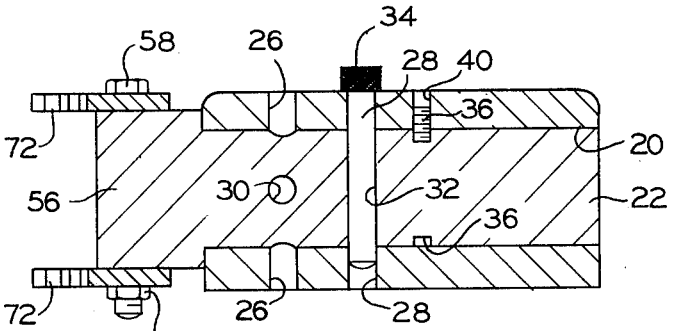
FIG. 5 is a sectional view taken along the line 5—5 of FIG. 1.

As shown in FIG. 5, the base member 20 includes a pair of apertures 26 and 28 generally perpendicular and centrally located relative to the central aperture 20. A pair of perpendicularly disposed apertures 30 and 32 of the same diameter as the apertures 26 and 28 are formed in the cylindrical portion 22. The apertures 30 and 32 are formed such that, when the support 24 is rotated to align the apertures 30 and 32 with the apertures 26 and 28, respectively, a securing pin 34 can be inserted in the pair of aligned apertures to prevent any relative rotative movement between the support 24 and the base member 12. Since the aperture 30 is perpendicular to the aperture 32, the support member 24 can be rotated and secured relative to the base member 12 at 90° intervals. It will be appreciated that, in some instances, it may be desirous to secure the support member 24 and base member 12 at intervals other than 90° . An annular groove 36 formed in the cylindrical end 22 cooperates with a set screw 38 mounted within an internally threaded aperture 40 in the base member 12 to prevent relative axial movement of the support 24 with respect to the base member 12 when the securing pin 34 is removed.

The vise 10 further includes a clamp means, generally indicated by the numeral 42, comprising a pair of pivotally interconnected jaw member 44 and 46. Each of the jaw members 44 and 46 includes a pair of spaced apart arm plates. The jaw member 44 includes arm plates 48 and 50, while the jaw member 46 includes arm plates 52 and 54. The jaw member 42 is secured to a block end 56 of the support 24 by means of a pair of threaded bolts 58 extending through apertures formed in the plate 48, the block end 56, and the plate 50. The lower ends of the bolts 58 have fastening nuts 60 attached thereto. The jaw member 46 is pivotally connected to the jaw member 44 by means of a threaded bolt 62 extending through apertures formed in the plates 48 and 52, down through a cylindrical spacer sleeve 63 and through apertures formed in the plates 50 and 54. A fastening nut 64 is tightened to a point which permits the jaw member 46 to pivot relative to the jaw member 44. A pair of spaced apart bolts 66 are provided along with cylindrical spacer sleeves 68 and retaining nuts 70 to maintain the arm plates 52 and 54 in a spaced apart relationship.

The jaw members 44 and 46 are each provided with workpieces engaging surfaces in facing relation to one another, such as gripping teeth 72 and 74, respectively. Both the upper and lower arm plates of each jaw member can be provided with gripping teeth. The gripping teeth provide an effective means to secure a workpiece such as a cylindrical member 75, shown in phantom in FIG. 1 or a MacPherson strut assembly 76, as shown in phantom in FIG. 3. The gripping teeth 72 and 74 are specially effective when utilized to support automotive assemblies which are often coated with undercoating, road tar, etc.

As clearly shown in FIG. 1, the generally arcuate workpiece engaging surfaces defined by the gripping teeth 72 and 74 are formed with a radius substantially equal to the radius of the cylindrical workpiece 75. The workpiece engaging surfaces of the jaw members 44 and 46 are interrupted at an intermediate area by notched portions 45 and 47 respectively which extend generally radially outwardly from the workpiece engaging surfaces. Such a construction enables the jaw members 44 and 46 to securely engage a cylindrical workpiece having a radius smaller than the radius of the workpiece 75. For example, when the jaw members are utilized to clamp a cylindrical workpiece having a radius smaller that the workpiece 75, the jaw members 44 and 46 would engage the smaller workpiece at points 45*a*, 45*b*, 47*a*, and 47*b*. This four point contact substantially increases the holding ability of the vise when used to clamp such smaller cylindrical workpieces. Also, in the event the vise is utilized to support a rack tube of a rack and pinion steering unit, the notched portions 45 and 47 provide a space for accommodating the power steering lines which typically run along the outside of the tube.

The end of the jaw member 46, which is opposite the end where the gripping teeth 74 are formed, is provided with a means generally indicated at 77, for pivoting the jaw member 46 relative to the jaw member 44 to move the gripping teeth towards one another. The pivoting means 77 includes a threaded actuating handle 78 and a cooperating internally threaded cylindrical handle support 80. The handle 78 includes gripping portions 82 which are fixed to the end of an elongate shaft 84 having external threads 86 formed on the one end proximate the gripping portions 82, and having a reduced diameter portion 88 at the opposite end. The extreme outer end of the reduced diameter portion 88 is provided with a rounded end 89. The support 80 has reduced diameter end portions 92 which extend through apertures formed in the plates 52 and 54. A pair of snap rings 94 cooperate with annular grooves formed in the ends 92 to permit the support 80 to rotate about its longitudinal axis. The support 80 has internal threads 96 formed therein to engage the threads 86 formed on the shaft 84.

The jaw member 44 includes a cylindrical spacer 98 positioned between arm plates 48 and 50. The spacer 98 has reduced diameter end portions 100 which extend through apertures in the plates 48 and 50 and are fixedly attached to each of the plates to prevent rotation of the spacer 98. The spacer 98 has a quarter section cut out or pocket 102 formed therein having a recessed portion 104 adapted to receive the rounded end 89 of the threaded shaft 84.

Figure 4:
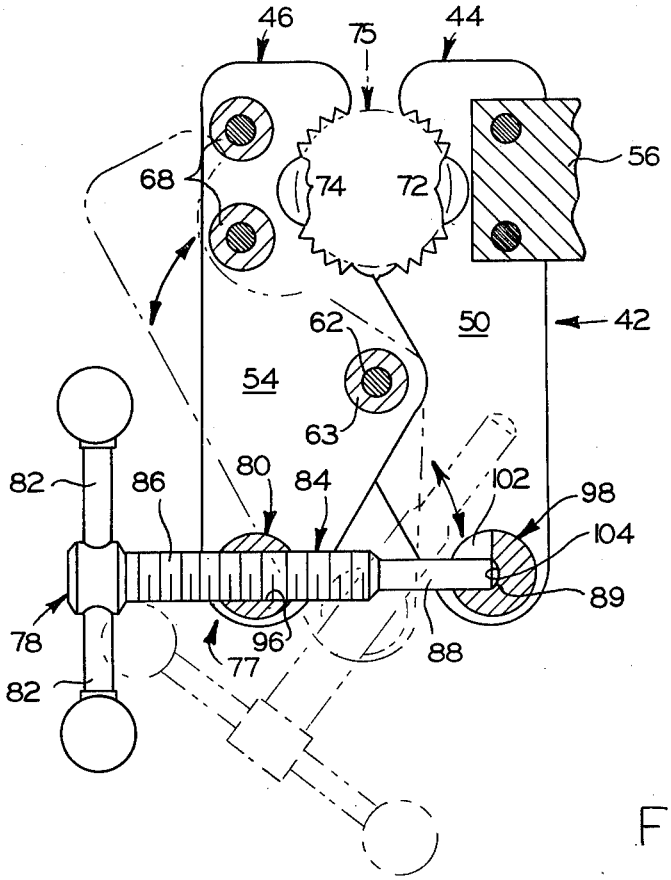
FIG. 4 is a sectional view taken along the line 4—4 of FIG. 2, illustrating in phantom the position of one of the jaw members of the clamp means after it has been pivoted to release the workpiece.

In operation, the clamp means 42 is first rotated with the support member 24 relative to the base member 12 to the desired working position. The securing pin 34 is then placed in either the aperture 26 or the aperture 28 and through the respective aperture 30 or 32 formed in the support member 24 to secure the clamp means relative to the base member. The user then grasps the gripping portion 82 of the handle 70 with one hand and, while pivoting the rounded end 89 out of engagement with the spacer 98, also pivots the jaw member 46 in a direction to move the gripping teeth 72 and 74 away from one another. This open position is illustrated in phantom in FIG. 4. Next, the user grasps the workpiece 75 to be supported with his other hand and positions it between the gripping teeth 72 and 74 of the two jaw members 44 and 46, respectively. while still holding the workpiece with one hand, the user pivots the jaw member 46 to move the gripping teeth toward one another while simultaneously pivoting the handle 78 about the support 80 to move the rounded end 89 into engagement with the recessed portion 104. The handle 78 is then rotated about the longitudinal axis of the shaft 84 to screw the shaft into the support 80. As the rounded end 89 engages the recessed portion 104, the jaw member 46 is pivoted relative to the jaw member 44 to cause the gripping teeth 72 and 74 to move toward one another and securely grasp the workpiece.

It will be appreciated that once the workpiece is secured, the user can rotate the workpiece to another position by removing the securing pin 34. It will also be appreciated that the workpiece can be quickly removed from the clamp means 42 by merely unscrewing the handle 78 a few turns sufficiently to permit the handle to pivot from the quarter section cut out 102. It should be noted that, in addition to supporting a MacPherson strut assembly, that vise 10 can also be effectively used to support a rack tube of a rack and pinion steering assembly (not shown).

In accordance with the provisions of the patent statutes, the principle and mode of operation of the invention have been explained in what is considered to represent its best embodiment. It should, however, be understood that the invention may be practiced otherwise than as specifically illustrated and described without departing from its spirit or scope.

What is claimed is:

1. An apparatus for securely supporting a generally cylindrical workpiece relative to a fixed support comprising:

a base member;

means for securing said base member to the fixed support;

clamps means rotatably mounted on said base member including a pair of jaw members pivotally interconnected, each of said jaw members including a pair of spaced apart, generally parallel plates and means for maintaining said plates in a generally parallel spaced apart relationship, each of said plates having a workpiece engaging surface thereon with said engaging surfaces of one of said jaw members in facing relation to said engaging surfaces of the other one of said jaw members, each of said workpiece engaging surfaces having a generally arcuate portion interrupted at an intermediate area by a notched portion extending generally radially outwardly from said arcuate portion;

means for releasably securing said rotatable clamp means relative to said base member to militate against any relative rotative movement therebetween; and means mounted on said clamp means for effecting pivotal movement of said jaw members relative to one another to move said workpiece engaging surfaces toward and away from one another whereby a workpiece positioned between said surfaces may be securely supported relative to the fixed support.

2. An apparatus according to claim 1 wherein said jaw members of said clamp means includes a fixed jaw member secured to said base member and a pivoted jaw member pivotally connected to said fixed jaw, and means mounted on said pivoted jaw and cooperating with said fixed jaw for effecting pivotal movement of said jaw members relative to one another to move said workpiece engaging surfaces toward and away from one another.

3. An apparatus according to claim 2 wherein said pivoted jaw member is pivoted to said fixed jaw member at a point intermediate said workpiece engaging surface and said means for effecting pivotal movement.

4. An apparatus according to claim 3 wherein said means for effecting pivotal movement of said jaws includes a threaded shaft for threaded engagement with a threaded shaft support mounted on said pivoted jaw member, said shaft including means on one end thereof for rotating said shaft about its longitudinal axis and means on the opposite end thereof for engagement with said fixed member whereby relative rotation of said threaded shaft about its longitudinal axis in one direction will effect axial movement of said shaft to pivot said jaw members relative to one another to move said workpiece engaging surfaces toward one another.

5. An apparatus according to claim 4 wherein said threaded shaft support is pivotally mounted on said pivoted jaw member to permit said threaded shaft to be pivoted about an axis perpendicular to the longitudinal axis of said shaft, said threaded shaft being pivoted to one position to engage the one end of said shaft with a cooperating pocket on said fixed jaw member whereby said threaded shaft can be rotated about its longitudinal axis to move said workpiece engaging surfaces toward one another, said threaded shaft being pivoted to a second position to move said threaded shaft out of engagement with said pocket on said fixed jaw member whereby said jaw members can be pivoted relative to one another to move said workpiece engaging surfaces away from one another without rotating said threaded shaft.

6. An apparatus according to claim 1 wherein said means for rotatably mounting said clamp means includes a support having one end securely mounted to at least one of said jaw members and having an opposite cylindrical end rotatably mounted to said base member.

7. An apparatus according to claim 6 wherein said releasably securing means includes a securing pin for insertion through a first aperture in said base member and into a cooperating first aperture in said cylindrical end for supporting said clamp means in a first position, said securing pin also insertable through a second aperture in said base member and into a cooperating second aperture in said cylindrical end for supporting said clamp means in a second position.

* * * * *